United States Patent [19]

Grosjean

[11] Patent Number: 4,999,823

[45] Date of Patent: Mar. 12, 1991

[54] WATCH CASE OVERLAID WITH A CAP GLUED TO THE CASEBAND

[75] Inventor: Laurent Grosjean, Neuchatel, Switzerland

[73] Assignee: ETA S.A. Fabriques d'Ebauches, Grenchen, Switzerland

[21] Appl. No.: 381,323

[22] Filed: Jul. 18, 1989

[30] Foreign Application Priority Data

Jul. 19, 1988 [CH] Switzerland ..... 02762/88

[51] Int. Cl.[5] ..... G04B 37/00

[52] U.S. Cl. ..... 368/295; 368/294; 368/281; 368/286

[58] Field of Search ..... 368/280–282, 368/276, 88

[56] References Cited

U.S. PATENT DOCUMENTS 4,474,482 10/1984 Gogniat ..... 368/296
4,831,606 5/1989 Aellen ..... 368/286

FOREIGN PATENT DOCUMENTS 3115737 2/1982 Fed. Rep. of Germany .
307046 7/1955 Switzerland .
1766468 10/1970 Switzerland .
517963 2/1972 Switzerland .

OTHER PUBLICATIONS

Neue Uhrmacher-Zeitung, vol. 23, Feb. 28, 1969, pp. 14–16, Ulm, DE; G. Schindler: "Neue Technologie-Klebe in der Uhrentechnik".

*Primary Examiner*—Bernard Roskoski
*Attorney, Agent, or Firm*—Griffin Branigan & Butler

[57] ABSTRACT

The watch case (1) of this invention includes a caseband-bezel (2) of plastic material overlaid with a metal cap (5). The cap is a metallic leaf formed to match the relief of the bezel (15) and caseband (16) which it overlays. The cap is secured to the caseband-bezel by glue preferably located in a receptacle (33) provided within the thickness of the caseband and extending at least partially along the periphery of said caseband.

6 Claims, 2 Drawing Sheets

WATCH CASE OVERLAID WITH A CAP GLUED TO THE CASEBAND

This invention concerns a watch case including a caseband-bezel, a crystal secured to the caseband-bezel and a cap covering entirely the bezel and extending at least partially over the side of the caseband.

BACKGROUND OF THE INVENTION

A watch case corresponding to the generic definition just given above is known from various prior documents.

In the patent document GB-A-102 641 the case is provided with a cap covering the caseband and including two loops. The cap is secured to the remainder of the case by fixing the strands of the bracelet in these loops. The drawbacks which such cases exhibit render them rather unattractive. Effectively, since the cap is not rigidly secured, it may readily be displaced on the caseband. Furthermore, the risk of having the cap torn off cannot be entirely eliminated.

The patent CH-A-558 040 describes a watch case including a protective cap of extra hard material. In this construction the cap is maintained in place by screws which are perpendicular to the plane of the case and which traverse the caseband-bezel and are retained in threaded studs attached under the cap. Here the cap exhibits a rather complex cross-section in view of these threaded studs. The caseband-bezel must be given a special form in order to be adapted to the cap which covers it.

Patent CH-A-517 963 (=US-A-3 242 664) describes a watch case including a caseband-bezel of steel surmounted by a cap formed of metallic carbide. Caseband and cap are fastened to one another by force fitting. The description in the patent at the same time mentions that in order to compensate for eventual variations in the dimensions of the cap it is preferable to glue the cap onto the caseband, the layer of glue thereby compensating any lack of precision.

Patent CH-A-307 046 suggests a cap of transparent plastic material covering the case, itself made of plastic material. The underside of the cap is covered by metallization the thickness of which may be very small (between 0.5 and 1 $\mu$m) since protected by the cap. The cap thus coated is glued to the case. In addition to the fact that this is a difficult construction, it will be noted that the outer portions of the cap made of soft material are subject to rapid deterioration (scratches, etc.).

To applicant's knowledge, it has never been proposed to cover a caseband-bezel of plastic material with a metallic cap and still less to glue these pieces to one another. The gluing of plastic material onto metal has long suffered and continues to suffer from unfavourable prejudices, leading to avoidance thereof as much as possible and being replaced by mechanical means judged safer and more reliable such for instance as the employment of screws or hooking devices. It is true that the caps known to the present time are heavy and massive and proof thereof may readily be seen in the drawings illustrating the cited documents. In view of their mass, such caps could readily be detached from a caseband made of plastic if they were simply glued thereto. However, if the cap is light, made from a blanked and drawn leaf and if furthermore one is able to choose judiciously the materials to be glued and the glue itself, the applicant has discovered that securing the cap by gluing it to the caseband is very satisfactory vis-a-vis the forces and stresses which are produced during wearing of the watch.

SUMMARY OF THE INVENTION

Thus, this invention is characterized by the fact that the caseband-bezel is realized of plastic material and that the cap is made of a metallic leaf formed to match the relief of the bezel and caseband which it overlays, said cap being secured to the caseband-bezel by means of glue interposed at least here and there between said cap and said caseband-bezel.

The advantages of such an arrangement will appear clearly upon reading of the description to follow and examination of the drawings which illustrate the invention by way of example.

DESCRIPTION OF THE PREFERRED EMBODIMENT

Figure 1:
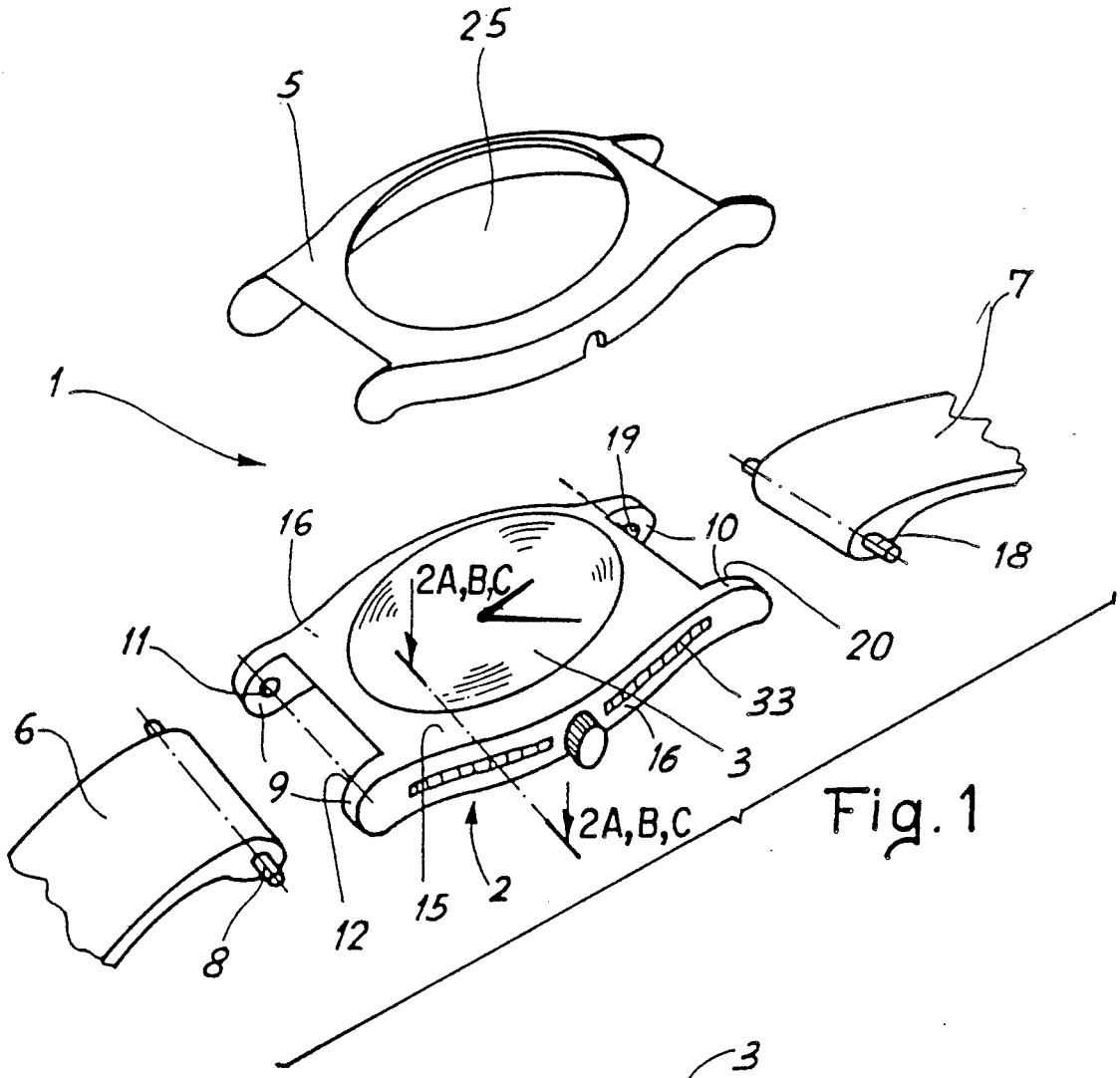
FIG. 1 is an exploded perspective view of the watch according to the invention.
Figure 2A:
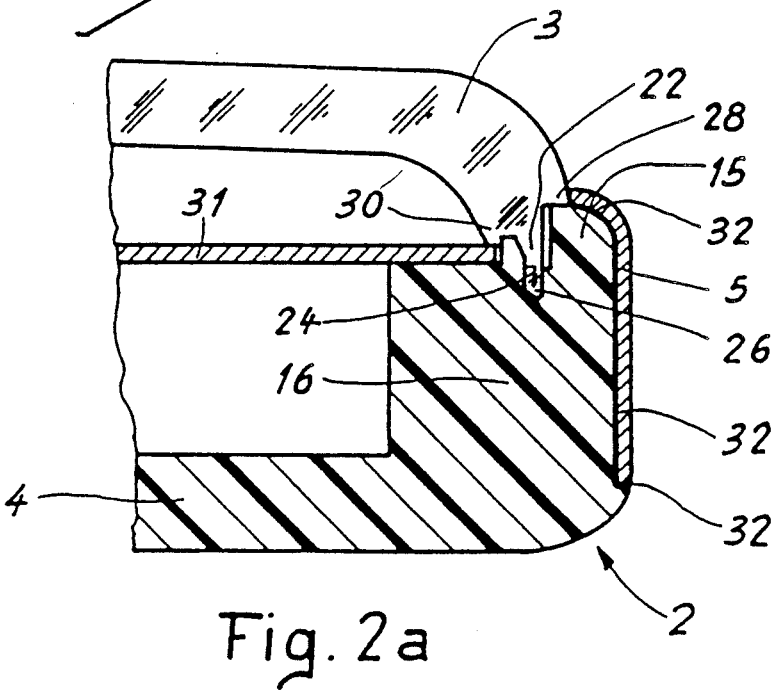
FIG. 2*a* is a cross-section along line II—II of FIG. 1 and according to a first embodiment of the invention, with the cap assembled onto the caseband-bezel.
Figure 2B:
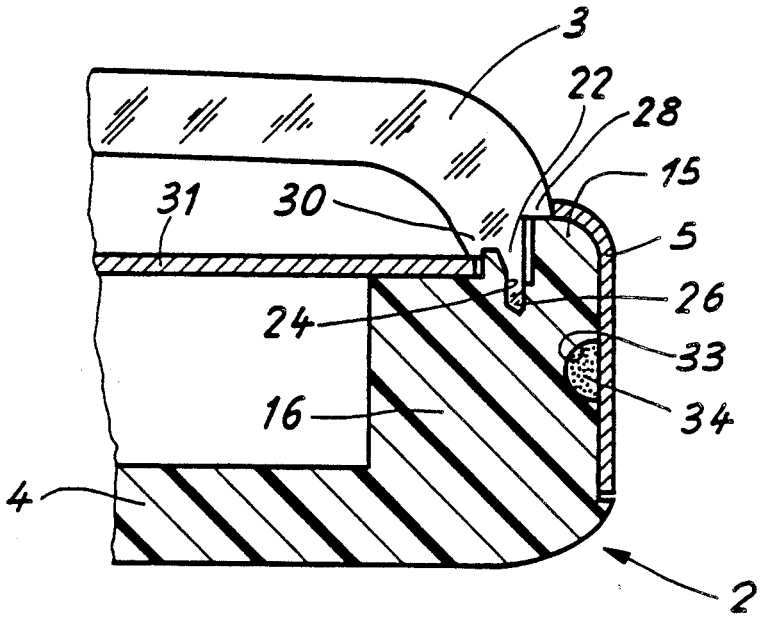
FIG. 2*b* is a cross-section along line II—II of FIG. 1 in accordance with a second embodiment of the invention, with the cap assembled onto the caseband-bezel.
Figure 2C:
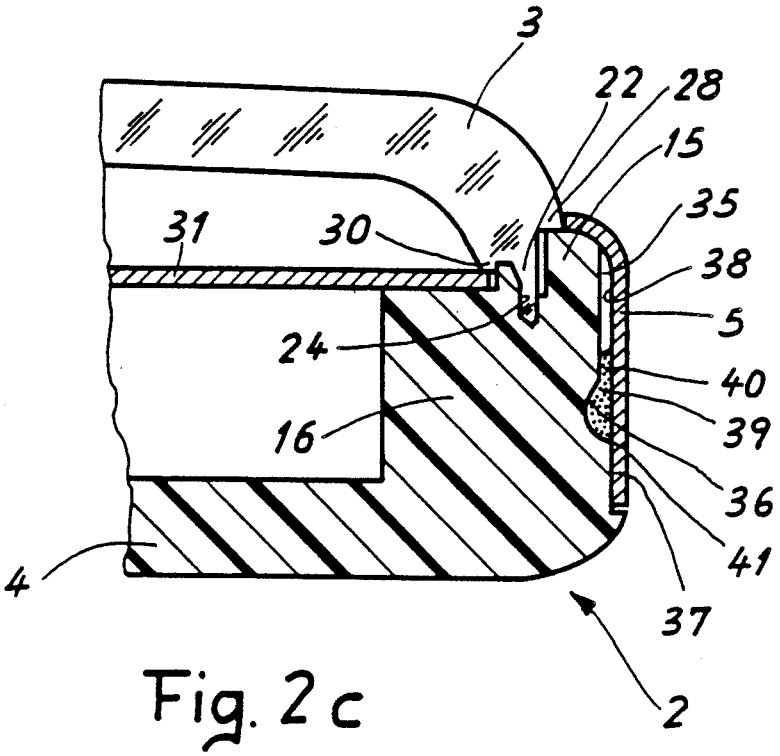
FIG. 2*c* is a cross-section along line II—II of FIG. 1 in accordance with a third embodiment of the invention always with the cap assembled onto the caseband-bezel.

The watch case 1 of FIG. 1 includes essentially a caseband-bezel 2, a crystal 3 secured to the caseband-bezel and a cap 5 arranged to overlay entirely the bezel portion 15 of the caseband-bezel 2, such cap extending at least partially over the length of the side presented by the caseband portion 16 of the caseband-bezel 2. On FIG. 1 it will be seen that the caseband-bezel includes two pairs of lugs 9 and 10 between which are articulated respectively half bracelets 6 and 7. The half bracelet 6 is articulated around a bar 8 threaded into holes 11 and 12 provided in lugs 9. In the same manner, half bracelet 7 is articulated about a bar 18 threaded into holes 19 and 20 provided in lugs 10.

As will be readily seen on FIG. 1 and in accordance with a basic characteristic of the invention, the cap 5 is made from a metallic leaf formed in a manner to match the relief of the bezel 15 and of the side of the caseband 16 which it overlays. The forming of the cap may include several stages, for instance an initial blanking followed by drawing. From these operations there results cap 5 with its opening 25, the contour of the bezel and the vertical walls covering the sides of the caseband. The thickness of the leaf has been chosen here to be 0.3 mm, but other thicknesses greater or less could also be suitable.

According to another characteristic of the invention, the caseband-bezel is formed of plastic material which leads to a very inexpensive watch to be manufactured in large series, but the impression of cheapness may readily be dissipated if the caseband-bezel is covered by a cap provided in accordance with the invention. Thus, for instance, the "Swatch" watch (registered trademark) known worldwide for its particular form and its very low price as well as its high quality manufacture, may constitute the caseband-bezel defined hereinabove. Such caseband-bezel could be provided with a cap thus giving to such watch a new aspect without changing its reputed form and without substantially changing its cost of manufacture. Thus, a cap made from a steel leaf, possibly coloured, changes the appearance of the watch, giving the impression that such watch is made of metal and this without in any manner changing its form.

According to the invention, it has been foreseen to secure the cap onto the caseband-bezel by means of glue interposed here and there between said cap and said caseband-bezel. In this respect several methods may be envisaged, three of which are shown by way of example, respectively in FIGS. *2a*, *2b* and *2c* which are cross-sections along line II—II of FIG. 1 with the cap assembled onto the caseband-bezel.

The watch case shown on FIGS. *2a* to *2c* includes a caseband-bezel 2 exhibiting among others a bezel portion 15 and a caseband portion 16. The caseband-bezel also includes a back cover 4 integrally formed with the caseband-bezel. This case further includes a crystal 3 and a cap 5. In the examples chosen here, the crystal and the caseband-bezel are formed of materials which can be welded to one another. The caseband-bezel may for instance be formed of one of the materials designated usually by ABS (acryl butadiene styrene), ASA (acryl styrene acryl-ester) or SAN (styrene acryl nitrile). The crystal is formed of a transparent acrylic resin (PMMA) regularly designated under the registered trademark "Plexiglass". The crystal may be fastened in several manners to the caseband-bezel. One method among others will now be briefly explained. The crystal 3 includes a lip 22 of cylindrical form engaged in a groove 24 of the caseband 16. The end of the lip 22 and the bottom of the groove 24 together form a ring 26 formed of a compound of the materials of the crystal 3 and the caseband-bezel 2. This ring 26 is formed upon welding by ultrasonic methods the crystal to the caseband-bezel, such welding bringing about melting of the materials of the end of the lip 22 and the bottom of the groove 24. Crystal 3 further includes a heel 28 covering the edge of the bezel 15. Another heel 30 borne by the crystal maintains the dial 31 in place.

As soon as the case has been assembled, as explained above, the cap 5 will be placed on the caseband-bezel 2, not without having previously coated with a fine layer of glue 32 either the internal wall of the cap or the external surface of the caseband-bezel coming into contact with the cap. This method of operation is illustrated on FIG. *2a*. It constitutes the simplest method of effecting the gluing according to the invention and according to a first embodiment.

FIG. *2b* shows a second embodiment of the invention. Here a receptacle 33 has been provided in the thickness of the caseband 16. This receptacle has also been shown on FIG. 1 where it will be seen that it extends partially along the periphery of the caseband 16. Before applying cap 5 onto the caseband-bezel 2, this receptacle will be filled with glue 34. This second embodiment is advantageous since it assures a type of locking of the cap onto the caseband-bezel. Effectively, since the glue sticks better to the metal than to the plastic material, it is at the junction with the caseband formed of plastic that it will fail if it is to fail and not at the junction with the metallic cap. The glue 34 thus constitutes a bead firmly anchored to the cap and preventing the latter from escaping from the caseband.

FIG. *2c* exhibits a third embodiment of the invention. In this arrangement the side of the caseband 16 covered by cap 5 exhibits successively starting from bezel 15 a first inset zone 35 which provides play between the caseband and the cap, a second zone exhibiting a receptacle 36 provided in the thickness of the caseband 6 and finally a third zone 37 arranged to be in contact with the internal wall 38 of cap 5, all of these zones extending at least partially the length of the periphery of caseband 16. In this embodiment the gluing is brought about in the following manner: prior to introducing the cap onto the caseband-bezel, a relatively thick coating of glue is applied to the internal wall 38 of cap 5 intended to face the third zone 37 of the side of caseband 16, then one introduces the cap onto the caseband. This action transports the glue by scraping it by means of the edge referenced 41, shown on the caseband, into the receptacle 36, the eventual surplus 40 passing into the first inset zone 35.

This third embodiment is the most complicated and requires more care than the two embodiments previously described. However, it exhibits the advantage of an execution having a better finish. Furthermore, the advantage mentioned in respect of the second embodiment remains.

There remain several details to be given in respect of the materials employed and the glue used in order to fasten them to one another.

It has already been mentioned that the cap 5 is of metal and the caseband-bezel is of plastic material. It will be noted that the use of ABS is recommended since glue adheres thereto without the necessity of applying any special treatment. On the other hand, material such as teflon, polyethylene or polypropylene require special preparations (baths, corona treatment, etc.) in a manner to render the surface of the material reactive in the presence of the glue.

Two families of glue may be employed. Initially, the types of glue referred to as structural reaction glues among which may be cited the epoxydes. Glue sold under the registered trademark "araldite" is particularly suitable here. Finally may be cited the types of glue referred to as thermoplastic which come in the form of plastic films which soften when heated. Here there may be mentioned ethyl vinyl acetate composing the product sold under the registered trademark "jetmelt".

The cap thus described could if necessary cover over a caseband-bezel without the necessity of modifying the latter in view of such covering. In most cases however it will be preferred to reduce somewhat the radial dimensions of the caseband in order that the completed watch exhibits the same aspect as that which has no cap. In such case one could avoid elongating the cap to the bottom of the caseband as shown on FIGS. *2a* to *2c*, such cap stopping against a flange forming a portion of the caseband.

What is claimed is:

1. A watch case including a caseband-bezel of plastic material, a crystal secured to the caseband-bezel, a metallic cap completely overlaying the bezel and extending at least partially over the side of he caseband, and a glue serving to secure said cap to said caseband-bezel, the side of the caseband overlaid by the cap having a receptacle provided within the thickness o the caseband and extending at least partially along the periphery of said caseband so as to receive said glue, the side of the caseband overlaid by the cap exhibiting starting from the bezel, a first zone, a second zone providing said receptacle within the thickness of the caseband and a third zone arranged to be in contact with an internal wall of the cap, said zones extending at least partially the length of the caseband periphery.

2. A watch case as set forth in claim 1 wherein said first zone is an inset zone providing play between the caseband and the cap, said inset zone extending at least partially the length of the caseband periphery, said receptacle serving to receive glue deposited on the internal wall of the cap facing said third zone when said cap is placed on said caseband.

3. A watch case as set forth in claim 1 wherein the glue comprises a structural reaction glue of the epoxyde type.

4. A watch case as set forth in claim 1 wherein the glue comprises a thermoplastic glue of the ethyl-vinyl-acetate type.

5. A watch case as set forth in claim 2 wherein said glue comprises a structural reaction glue of he epoxyde type.

6. A watch case as set forth in claim 2 wherein said glue comprises a thermoplastic glue of he ethyl-vinyl-acetate type.

* * * * *